United States Patent [19]

Kontz

[11] Patent Number: 4,468,277

[45] Date of Patent: Aug. 28, 1984

[54] FIXED JAW MEANS FOR HOLDING AND ROTATING CONTAINERS TRAVELING AROUND A TURRET PERIPHERY

[75] Inventor: Robert F. Kontz, Toledo, Ohio

[73] Assignee: Owens-Illinois, Inc., Toledo, Ohio

[21] Appl. No.: 510,484

[22] Filed: Jul. 5, 1983

[51] Int. Cl.[3] ..... B65C 9/04

[52] U.S. Cl. ..... 156/567; 156/DIG. 26; 198/653; 198/655; 198/803

[58] Field of Search ..... 156/86, 567, DIG. 25, 156/DIG. 26; 198/803, 653, 655

[56] References Cited

U.S. PATENT DOCUMENTS

| | | | |
|---|---|---|---|
| 2,888,127 | 5/1959 | Uhlig | 198/653 |
| 3,404,059 | 10/1968 | Ritterhoff | 156/567 |
| 3,460,669 | 8/1969 | Johnson | 198/803 |
| 3,948,711 | 4/1976 | Piatek | 156/567 |
| 4,184,309 | 1/1980 | Amberg | 156/86 |

*Primary Examiner*—Michael G. Wityshyn

*Attorney, Agent, or Firm*—John R. Nelson; Myron E. Click

[57] ABSTRACT

Fixed jaw means for receiving, holding, rotating and maintaining containers in a vertical alignment while traveling around a rotatable turret periphery is shown. The jaw means nests the container in the center of a pair of peripheral rollers and a pair of idler rollers.

2 Claims, 2 Drawing Figures

FIXED JAW MEANS FOR HOLDING AND ROTATING CONTAINERS TRAVELING AROUND A TURRET PERIPHERY

The present invention relates to means for holding in alignment and rotating containers as the containers travel around the periphery of a turret. The present invention more particularly relates to jaw means for holding and rotating containers around a turret periphery where oriented plastic tubular sleeves are telescopically assembled onto the container and heat-shrunk thereon during the travel around the periphery.

It is desirable to have compact jaw means for holding containers as they travel around a turret periphery, the jaw means holding the containers in alignment while rotating and transporting the containers around the periphery for an operation such as telescopically assembling oriented plastic tubular sleeves on the containers and heat-shrinking the sleeves thereon. It is particularly desirable to have inexpensive, compact jaw means to hold the containers in order to easily and efficiently hold, rotate and control the containers as they travel around the turret periphery.

It is an object of the present invention to provide a compact jaw means for holding containers in alignment on the turret periphery, the fixed jaw means controlling, rotating, and holding each of the containers in vertical alignment after only a very short arc of travel on the turret periphery.

It is an object to provide a fixed jaw means that maintains control of the containers quickly after only a short arc of travel on the turret periphery, the jaw means holding the containers in vertical alignment while transporting and rotating the containers around the periphery of a turret.

Figure 1:
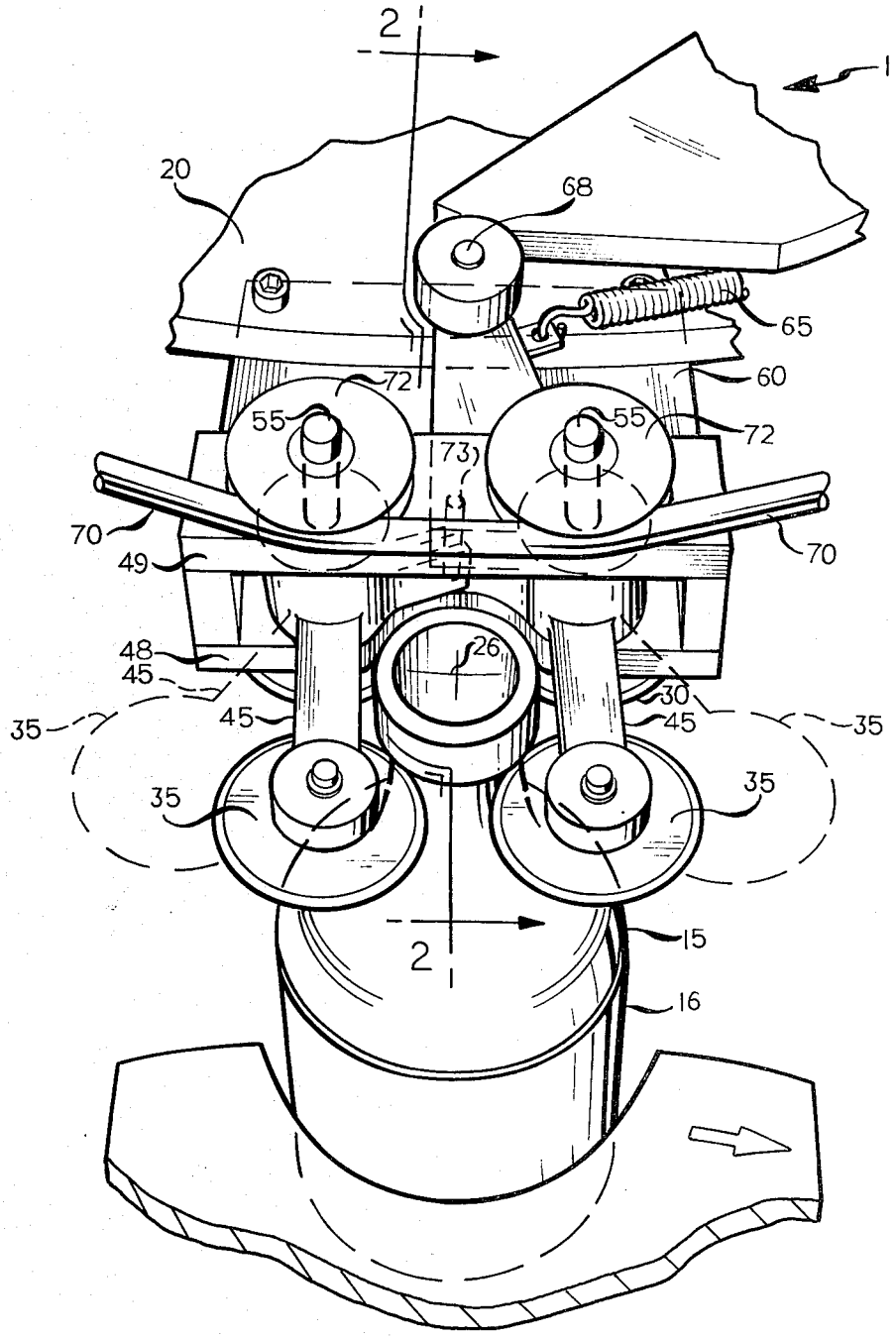
Figure 2:
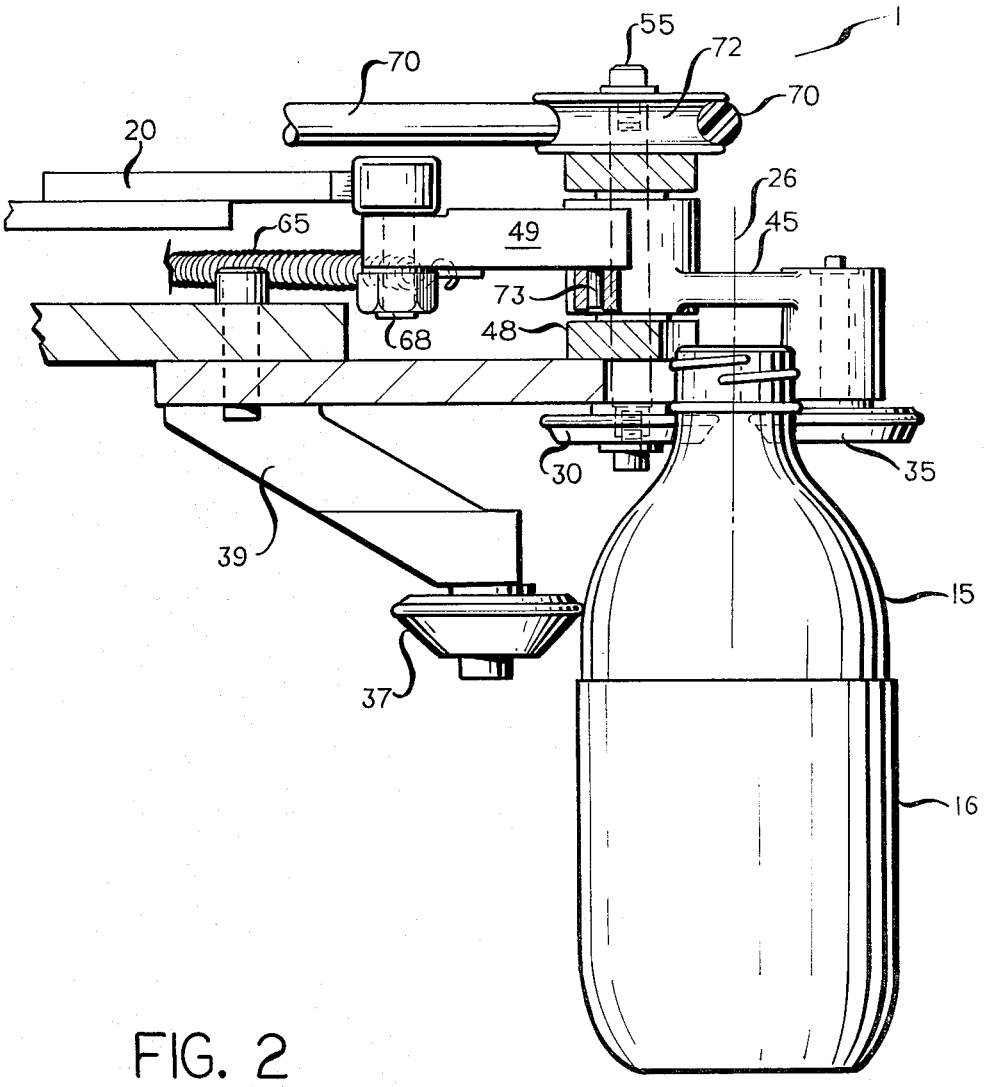

These and other objects will become apparent from the specification that follows, the appended claims, and the drawings, in which:

FIG. 1 is a fragmentary perspective view showing the fixed jaw means of the present invention mounted on the peripheral edge of a rotatable turret; and FIG. 2 is a fragmentary elevational view of the fixed jaw means of the present invention taken along the line 2—2 of FIG. 1.

The present invention provides fixed jaw means for holding containers especially adapted for use in a machine comprising a rotatable turret in which containers travel around the turret periphery and are provided with oriented plastic tubular sleeves that are heat-shrunk thereon, the machine being described in a U.S. patent application Ser. No. 510,482 for Robert F. Kontz, entitled "Methods and Machines for Placing and Heating Oriented Plastic Heat-Shrinkable Sleeves on Containers," assigned to the same assignee as the present application, and being filed concurrently herewith. This application is incorporated by reference.

The present invention provides novel fixed jaw means and methods for holding and rotating containers around a turret periphery, the jaw means being so constructed and arranged that the upper portion of each container is grasped, controlled, and rotated as the containers travel around the turret periphery.

The present invention provides novel jaw means for a machine for putting heat-shrinkable oriented plastic sleeves on containers, the machine comprising a turret having an upper portion and a lower portion, means for transporting containers around the upper turret portion periphery including fixed jaw means for holding and rotating the container as it travels around the turret periphery, the fixed jaw means so constructed and arranged that a pair of rollers connected by a member travel and rotate about the turret periphery, the fixed jaw means further including a pair of idler rollers, each idler roller connected to one peripheral roller by an arm, the arms being hingeably connected to the member and being held in the normal closed position, the idler rollers being separable to an open position to allow the upper portion of a bottle to be inserted into the center of the rollers and idler rollers to nest therein whereby the container is transported and rotated around the periphery.

The present invention also provides a method for holding and rotating containers around a turret periphery, the method comprising the steps of: (a) feeding containers, one by one, into a turret periphery, in generally vertical alignment; (b) holding the containers and rotating the containers by controlling each of the containers in a fixed jaw means including a pair of driven rotating rollers and a pair of idler rollers; and (c) maintaining the alignment by nesting the container between the pair of rotating rollers and the pair of idler rollers as the containers travel around the turret periphery.

As seen in the drawings, fixed jaw means 1 are provided to receive, control, transport and rotate container 15 that may have heat-shrinkable oriented plastic sleeves 16 thereon around a rotatable turret having a driven disc 20 that rotates around the turret center. The disc 20 has the fixed jaw means 1 rigidly connected thereto, the means 1 being so constructed and arranged that each container is held and maintained in an upright vertical position and rotated as the jaw means 1 and container travel around an upper turret portion periphery 26 by the center of the bottle that nestles in the center of a pair of driven periphery rollers 30 and a pair of idler rollers 35.

As seen in FIG. 2 an idler roller 37 is rigidly connected to a lower plate 38 of the jaw means 1 by an arm 39, the roller 37 contacting the bottle 15 in the upper middle portion to help stabilize the bottle and maintain its vertical alignment along with the driven peripheral rollers 30 and idler rollers 25 that contact the neck portion of the container preferably under the ledge area generally found in, for instance, oriented plastic carbonated beverage bottles including biaxially oriented polyethylene terephthalate bottles.

Each idler roller 35 is connected to a peripheral roller 30 by an arm 45. The idler rollers 35 are connected by an upper plate member 49 and a lower plate member 48.

Each of the arms 45 is hingeably connected to the plate members 48 and 49, the arms 45 when released being pivotable about the pivot point bolts 55, the arms 40 and rollers 35 being controllably urged towards each other to maintain contact with the container 15 by means of the force exerted on connecting plate 60 by a spring 65, the plate 60 being hingeably connected to the driven disc 50 by a pin 68.

As seen in the embodiment shown in the drawings, rope drive means including a rope 70 is provided, the fixed jaw means 1 having a pair of upper pulleys 72 that revolve as the jaw means is rotated around the turret periphery. In the embodiment shown, the rope is tied down at each end, but the rope could be driven or other means used to rotate the peripheral rollers 30 to provide the rotation to each container 15 as it travels around the turret periphery.

A pin 73 is provided to connect the connecting plate 60 with the plate member 49 and the arms 45. The arms 45, rollers 35 and rollers 30 can be set to accommodate a particular container diameter and neck size, the arms 45 and rollers 30, traveling as shown by dot-dash lines.

The fixed jaw means of the present invention advantageously allows each container to be gripped in much less linear or arcuate travel length on the turret periphery, thus providing for more processing time on the turret periphery. The rate of rotation of each container can be controlled in both direction and rate of rotation while the machine is running using the compact, inexpensive jaw means of the present invention.

What is claimed is:

1. A machine for putting heat-shrinkable oriented plastic sleeves on containers, the machine comprising a turret having an upper portion and a lower portion, means for transporting containers around the turret periphery including fixed jaw means for holding and rotating the container as it travels around the turret periphery, the fixed jaw means so constructed and arranged that a pair of peripheral rollers connected by a member travel and rotate about the turret periphery, the fixed jaw means further including a pair of idler rollers, each idler roller connected to one peripheral roller by an arm, the arms being hingeably connected to the member and being held in the normal closed position, the idler rollers being separable to an open position to allow the upper portion of a bottle to be inserted into the center of the peripheral rollers and idler rollers to nest therein whereby the container is transported and rotated around the periphery.

2. A method for holding and rotating containers around a turret periphery, the method comprising the steps of:

A. feeding containers, one by one, into a turret periphery, in generally vertical alignment;

B. holding the containers and rotating the containers by controlling each of the containers in a fixed jaw means including a pair of driven rotating rollers and a pair of idler rollers; and C. maintaining the alignment by nesting the container between the pair of rotating rollers and the pair of idler rollers as the containers travel around the turret periphery.

* * * * *